US005372457A

United States Patent [19]

Rante

[11] Patent Number: 5,372,457

[45] Date of Patent: Dec. 13, 1994

[54] METHOD AND APPARATUS FOR INSTALLING DRAINAGE CHANNELS

[76] Inventor: Raymond M. Rante, 2819 Kensington Ave., Westchester, Ill. 60153

[21] Appl. No.: 41,557

[22] Filed: Apr. 2, 1993

[51] Int. Cl.[5] ..... E02B 5/00

[52] U.S. Cl. ..... 405/119; 52/155; 248/87; 404/3; 405/154

[58] Field of Search ..... 405/118, 119, 122, 154, 405/157, 172; 248/49, 70, 71, 87; 52/155; 404/2–4

[56] References Cited

U.S. PATENT DOCUMENTS

| | | | |
|---|---|---|---|
| 391,790 | 10/1888 | Griswold | 52/155 |
| 444,496 | 1/1891 | Laybourn | 405/119 |
| 1,278,774 | 9/1918 | Smith | 248/87 X |
| 3,568,455 | 3/1971 | McLaughlin et al. | 405/154 |
| 3,823,905 | 7/1974 | Ray | 248/87 |
| 4,043,139 | 8/1977 | Scott | 405/154 |
| 4,099,354 | 7/1978 | DePirro | 52/146 |
| 4,498,807 | 2/1985 | Kirkpatrick et al. | 405/43 |
| 4,878,782 | 11/1989 | Beattie et al. | 405/119 |

*Primary Examiner*—David H. Corbin
*Attorney, Agent, or Firm*—Gardner, Carton & Douglas

[57] ABSTRACT

A support device for maintaining drainage channel segments at a predetermined elevation above the earth, as surface material is poured and rises from the subgrade level to the finished grade level. Disclosed is an elongated rod with a sharp triangle-shaped tip which is driven into the earth and partially rotated so as to irretractably anchor the rod in the earth. Attached to the other end of the rod is a bracket for securely attaching to a drainage channel segment. Substantial stability is imparted to the support device by means of a flat plate which is forced against the earth with a nut which is threadedly engaged upon a threaded portion of the rod.

6 Claims, 2 Drawing Sheets

METHOD AND APPARATUS FOR INSTALLING DRAINAGE CHANNELS

FIELD OF THE INVENTION

The present invention relates generally to the field of drainage channel installation, and more particularly to a superior and efficient installation technique.

BACKGROUND OF THE INVENTION

When constructing parking lots, driveways or other relatively flat surfaces with an appreciable surface area, it is conventional to install a fluid drainage system. Such a system is typically constructed of a series of elongated drainage channel segments disposed below yet flush with the finished grade level in order to permit the entry and channeling of fluid to a predetermined drainage site.

Prior art installation techniques have proven to be rather time consuming and labor intensive, and frequently result in a poor and uneven installation of the drainage channel segments. One of the most common installation problems is the tendency of the naturally buoyant drainage channel segments to float or otherwise move out of alignment when concrete, asphalt or similar material is poured and fills in about the periphery of the segments.

One prior art installation technique involves preparation of a trench, after the surface has been created in order to facilitate subsequent installation of the drainage channel segments. The segments are temporarily suspended within the channel by attachment to a plurality of laterally extending boards resting on the surface on either side of the trench. As concrete is poured into the trench, however, the segments tend to float upwardly, resulting in an uneven installation of the drain segments.

Another prior art installation technique is disclosed in U.S. Pat. No. 4,498,807 to Kirkpatrick, assigned to Polydrain, Inc. That technique involves driving an elongated spike into the earth which is connected to a "chair" that is attached to a drainage channel segment. The spike, however, tends to move mad may become dislodged during installation, resulting in uneven installation of the segments.

SUMMARY OF THE INVENTION

It is an object of the present invention to provide a technique for installation of a drainage channel system which is efficient and ensures that the drainage channel segments remain stationery as concrete, asphalt or other material is poured about the periphery of the channel segments.

It is another object of the present invention to provide an apparatus for securely supporting drainage channel segments at a predetermined elevation above the ground, wherein such apparatus is substantially irretractable.

It is another object of the present invention to provide an apparatus for securely supporting drainage channel segments at a predetermined elevation above the ground which provides substantial stability for the drainage segments as concrete is poured about their periphery.

The above and additional objects are realized in the present invention which provides an apparatus for securely supporting drainage channel segments at a predetermined elevation above the ground. The apparatus includes an elongated rod having a generally flat, triangular-shaped tip with a generally flat back surface. At its upper end, the triangular-shaped tip extends transversely a distance beyond the diameter of the rod. In order to irretractably secure the rod into the ground, the rod with the triangular-shaped tip is driven into the ground to the desired depth and then rotated approximately 90° about its axis. In a preferred embodiment, the rod is threaded along at least a portion and carries a plate which may be firmly biased against the ground by means of a nut which is threadedly engaged upon the rod. The biasing force between the triangular-shaped tip and the plate imparts a surprising degree of stability to the apparatus. Attached to the upper end of the rod is a bracket which may be securely bolted to a drainage channel segment.

BRIEF DESCRIPTION OF THE DRAWINGS

Other objects and advantages of the invention will be apparent from the following detailed description and upon reference to the drawings, in which.

DETAILED DESCRIPTION OF THE PREFERRED EMBODIMENT

Figure 1:
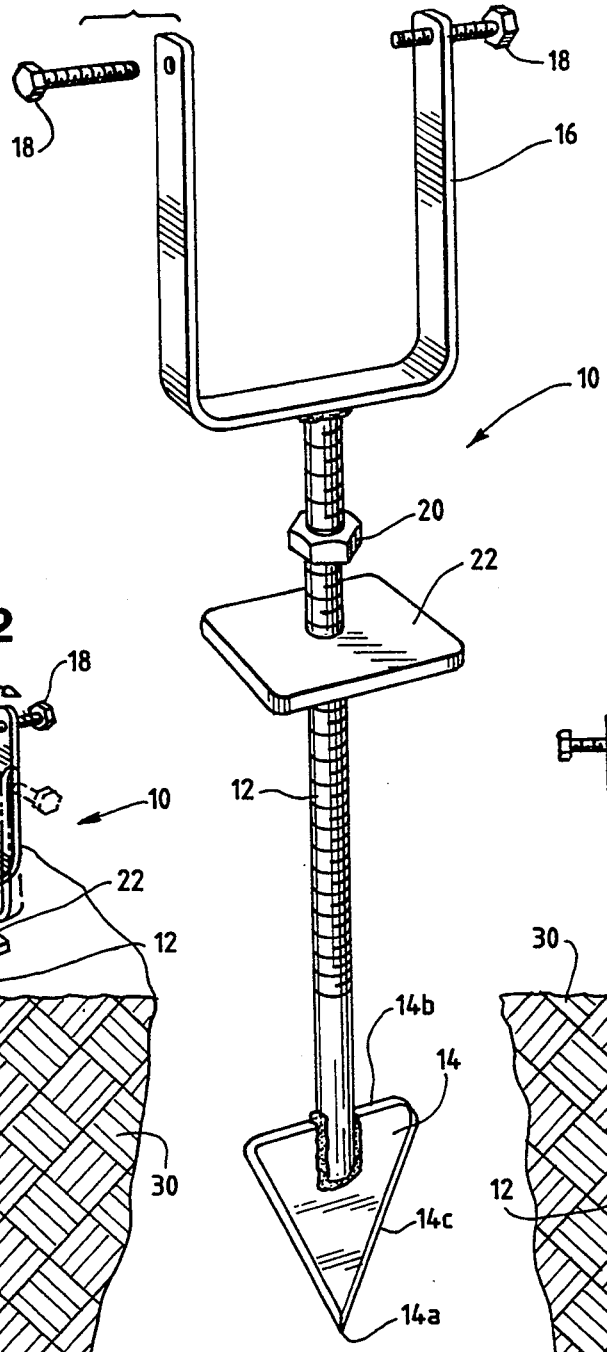
FIG. 1 is a perspective view of a preferred embodiment of the invention.

While the invention is susceptible to various modifications and alternative forms, a preferred embodiment thereof has been shown by way of example in the drawings and will herein be described in detail. It should be understood, however, that it is not intended to limit the invention to the particular form described, but to the contrary, the intention is to cover all modifications, equivalents, and alternatives falling within the spirit and scope of the invention as defined by the appended claims.

Turning now to the drawings and referring first to FIG. 1, there is shown a drainage channel support device 10 in accordance with the present invention. The device is comprised of an elongated rod 12 with a triangle-shaped tip 14 attached at one end and a generally U-shaped support bracket 16 attached at the other end. The tip 14, and the bracket 16, may be attached to the rod 12 by welding or any other conventional method that securely fastens the tip 14 and the bracket 16 to the rod 12. Preferably, the shape and the size of the bracket 16 conforms rather closely to the periphery of a drainage channel segment. On both sides at the distal end of the bracket 16 there is provided a bolt 18 or other adjustable element which may be tightened against the side walls of a drainage channel segment. According to a preferred embodiment of the invention, the tip of the bolts 18 are ground to a point in order to facilitate secure attachment to the sides of a drainage channel segment.

At least a portion of the rod 12 is threaded so as to threadedly engage a nut 20. Also carried on the rod 12 is a plate 22 which is designed to operate in conjunction with nut 20 to be tightened flush against the surface of the earth when the device 10 is installed for operation. Preferably, the triangular shaped tip 14 will have a relatively sharp leading edge 14c which comes to a point 14a to facilitate driving the rod 12 into the earth. In order to firmly retain the rod 12 in the earth, the tip 14 is preferably provided with a relatively flat back surface 14b which, after the rod and attached tip 14 are partially rotated, firmly abut against the earth, thereby securely retaining the support device 10 in the earth. As can be seen, at its upper end, the tip 14 extends transversely a distance greater than the diameter of the rod 12.

Figure 2:
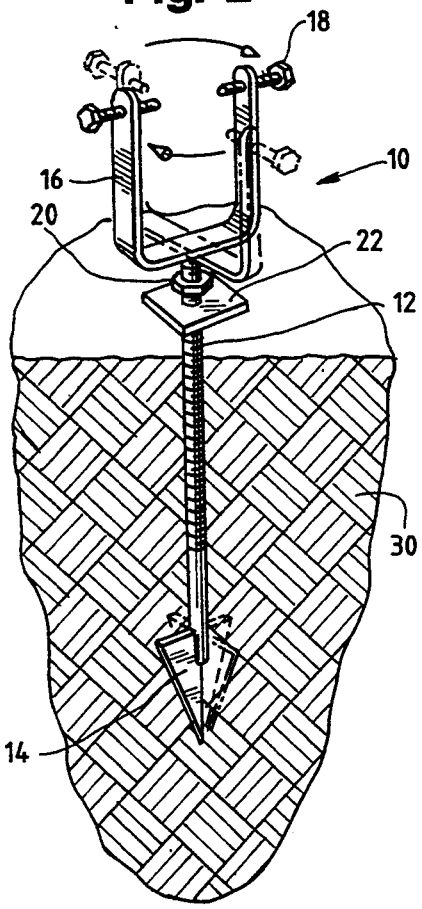
FIG. 2 is a perspective view depicting insertion of the present invention in the ground at subgrade level.

Turning now to FIG. 2, there is illustrated a method for installing the support device 10 of the present invention into the earth 30 at subgrade level according to a preferred embodiment. The support device 10 is positioned at a predetermined location, for example, at a point along a line where it is desired to install a drainage channel, and is driven into the earth 30 by any conventional means. The central portion of the horizontal segment of the bracket 16 may be used for pounding the support device 10, with the leading triangular shaped tip 14, into the earth 30. The rod 12 is driven into the earth 30 to a predetermined depth, which may be indicated by one or more score or graduation marks on the surface of the rod 12, in order to maintain the bracket at a predetermined desired elevation above the earth 30 at subgrade level. Alternatively, during installation, a horizontal plumb line may be set up to serve as a guide indicating the appropriate depth that the rod 12 should be inserted into the earth 30. The rod 30 is driven into the earth by any conventional means so as to dispose the bracket 16 at a predetermined elevation above the earth 30.

The process of driving the support device 10 with the leading tip 14 into the earth 30 will create a vertical channel in the earth 30 which rather closely conforms to the cross-sectional shape of the tip 14 of the rod. As illustrated in FIG. 2, in order to more securely and firmly install the device 10 in the earth 30, as well as to prevent displacement of the rod 12 or pulling it out along the channel formed in the earth 30 during insertion, the device 10 is preferably rotated partially so that the tip 14 assumes a position which is not in alignment with the channel in the earth. For example, the device 10 may be rotated approximately one quarter of a turn (i.e., 90°) from the position in which it was initially driven into the earth 30. Thus, if upward force is applied to the device 10, such as by lifting on the bracket 18, after the device 10 has been partially rotated, the upper back surface 14b of the tip 14, particularly the portions of the tip 14 which extend transversely beyond the diameter of the rod 12, will firmly abut against the earth 30, thereby preventing the device 10 from being displaced. Of course, if the tip 14 is aligned with the channel in the earth 30 formed during insertion, the device 10 may be rather readily retracted along the channel. As shown, the triangular shaped tip 14 is an important feature of the invention in that it facilitates driving the device 10 into the earth 30 and, when the device 10 is partially rotated after insertion, the tip 14 prevents displacement. By this technique, the device 10 of the present invention is selectively irretractable.

According to an important aspect of a preferred embodiment of the present invention, when the device 10 is manufactured the bracket and the triangular tip will assume substantially the same lateral position with respect to the rod. In other words, the bracket, including its sides, will be disposed in substantially the same vertical plane as the triangular tip. Therefore, when the rod is driven into the ground, the angular position of the tip may be determined by reference to the position of the bracket, as can be seen in FIG. 2.

Figure 3:
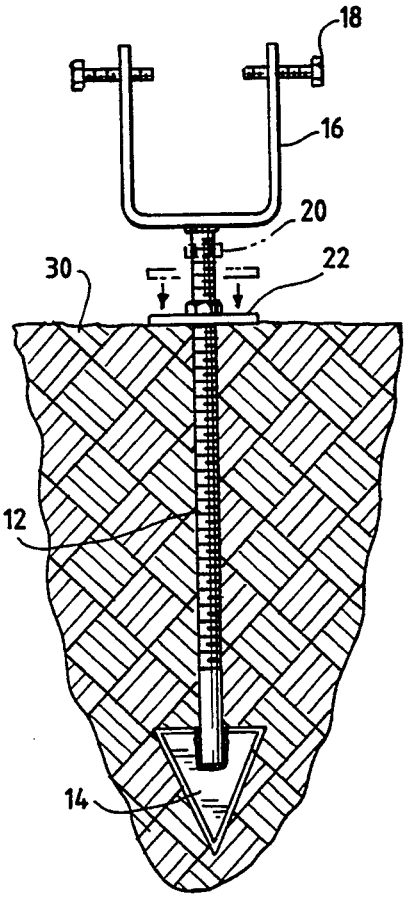
FIG. 3 is a side view depicting tightening of the spacer plate in accordance with a preferred embodiment of the invention.

Referring now to FIG. 3, there is illustrated adjustment of the stabilizer plate 22 in accordance with a preferred embodiment of the invention. After the rod 12 is driven into the earth 30 to the desired depth and the device 10 is rotated so as to irretractably position the tip 14, the stabilizer plate 22, which is carried upon the rod 12, is adjusted so it is forced flush against the earth 30. The nut 20, which is threadedly engaged upon the rod 12 is turned so it is tightened against the plate 22, and is thereby forced against the earth 30. The combination of the force of the plate 22 against the earth 30 and the force of the upper back surface 14b of the tip 14 against the earth 30 firmly biases the device 10 in position and securely stabilizes the bracket 16 at a predetermined elevation above the earth 30.

Figure 4:
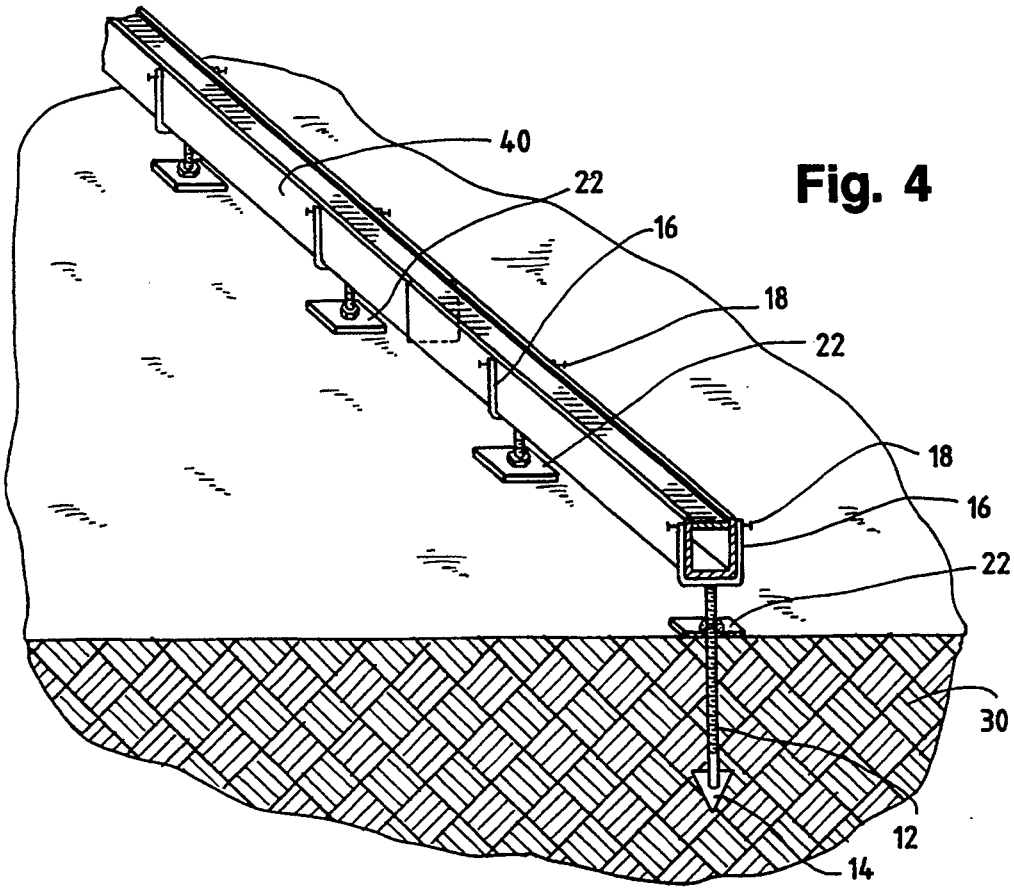
FIG. 4 depicts use of a plurality of support devices in alignment to provide support for a plurality of drainage channel segments.
Figure 5:
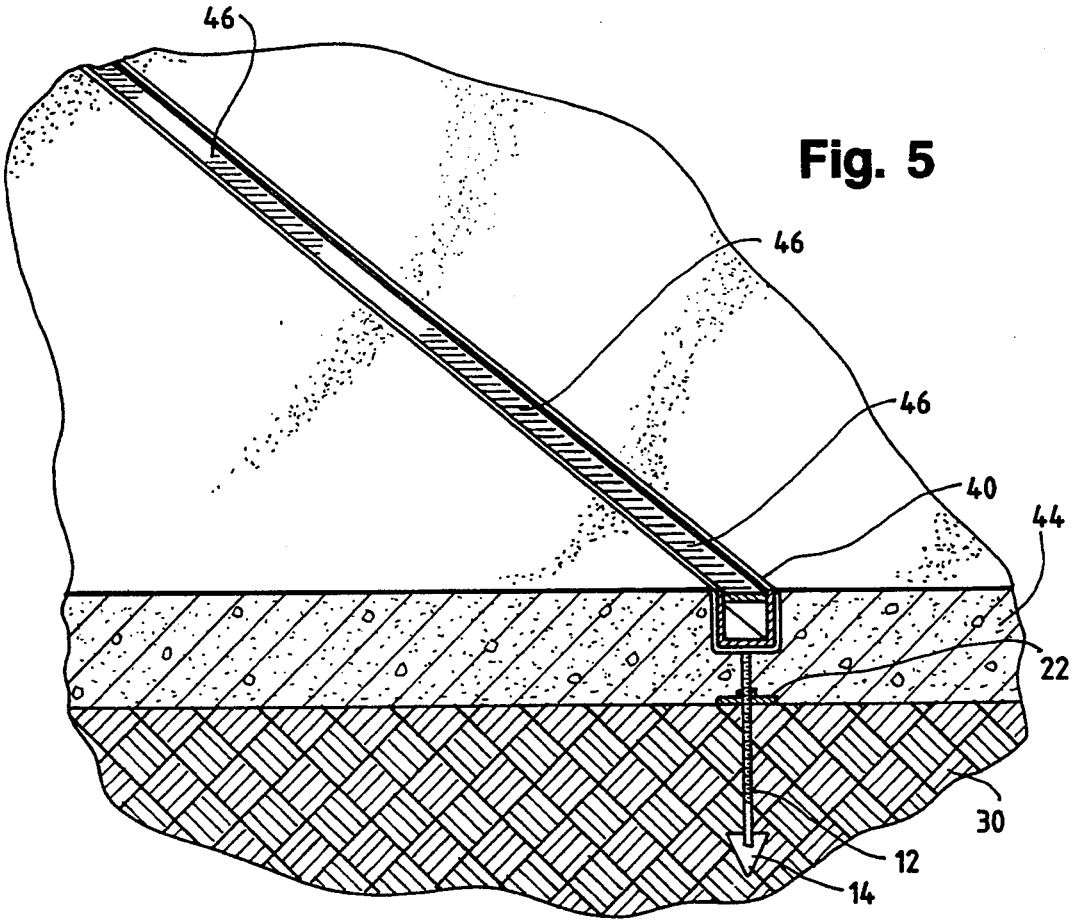
FIG. 5 depicts the present invention in the configuration of FIG. 4 after concrete or other surface material has been poured up to finished grade level.

Turning now to FIG. 4, there is illustrated a plurality of devices 10 which have been installed in alignment in order to provide support for a plurality of drainage channel segments 40. As can be seen, each of the brackets 16 are positioned so as to receive and provide support about the periphery of the segments 40. Bolts 18, which are threadedly engaged in the upper portion of the side segments of the bracket 16, securely fasten the drainage channel segments 40 to the device 10. As should be evident, as depicted in FIG. 4, the device 10 has already been rotated about one quarter of a turn from the position it assumed when initially inserted into the earth 30. Thus, when initially inserted, the brackets 16 assumed a position generally longitudinal to the drainage segments 40 and have been rotated about 90° to a position which is generally transverse to the drainage segments 40. In addition, the spacer plates have been securely tightened against the surface of the earth 30, thereby firmly biasing the plate with respect to the back 14b of the tip 14 and imparting a surprising degree of stability to the device 10.

In order to provide adequate support for each of the drainage channel segments 40, preferably at least two support devices 10 will be used to support each segment 40. The segments are connected together in any conventional manner, such as by a tongue and groove arrangement or by a compression fit. After all the segments 40 that will comprise the drainage channel have been installed and secured to the brackets 16 with the bolts 18, surface material 44, such as concrete or asphalt, may be poured. As the surface material 44 is poured it will rise about the periphery of the segments 40 which are secured in position with the support devices 10. When the surface material 44 rises to the finished grade level, pouring is halted and the surface is flush with the top of the drainage channel formed from a plurality of connected channel segments 40. As can be seen, when pouring of the surface material 44 is complete, the surface material 44 completely encases the support devices and the drainage channel segments, leaving only the top side of the channel segments 40 open to receive fluids for drainage. As is conventional in the industry, a plurality of grating strips 46, with a plurality of apertures or inlets that allow fluid to enter the channel, cover the channel segments 40 to prevent objects from accidentally falling into the channel. In addition, the grating strips 46 provide continuity as well as a degree of support of the finished grade surface, thereby allowing vehicles and pedestrians to traverse the finished surface without risk of injury or interruption.

According to an important aspect of the present invention, using the support device as disclosed herein allows pouring the surface material to be performed in a single step, rather than in two stages as is necessary according to prior art techniques which require formation of a trench in the surface material before a drainage channel support apparatus may be assembled. In contrast, the support devices of the present invention provide a surprising degree of stability for the channel segments and are self-standing, eliminating the prior art requirement of formation of a trench prior to installation. As illustrated in conjunction with FIG. 4, all of the drainage channel segments may be assembled and supported by the plurality of support devices of the present invention before any surface material is poured. Since the support devices securely retain the channel segments in a predetermined desired position, all of the surface material necessary to fill from the earth at subgrade level to the top of the channel segments at finished grade level may be poured at one time, without risk of displacement or floating away of the drainage channel segments.

What is claimed is:

1. A drainage channel support device for maintaining a drainage channel segment at a predetermined elevation above the earth, wherein said support device is comprised of:

an elongated rod;

a generally flat tip in the shape of a triangle attached at one end of said rod, wherein one corner of said triangle is disposed distal of said rod and is relatively sharp so as to facilitate driving said triangle-shaped tip into and below the surface of the earth, wherein the side of said triangle opposite said distal corner bears a relatively flat surface area, generally perpendicular to said rod, which is adapted to abut the earth when said rod is inserted into the earth and partially rotated;

bracket means attached to the other end of said elongated rod, wherein said bracket means conforms rather closely to the periphery of a drainage channel segment;

stabilization means comprised of a generally flat plate and engagement means for engaging said plate upon said rod and for forcing said plate against the earth, wherein substantial stability is imparted to said device by the biasing force between said plate and the flat surface of said triangle-shaped tip.

2. A support device as claimed in claim 1 wherein said rod is threaded along at least a portion of its length and wherein said engagement means is threadedly engaged upon said threaded portion of said rod.

3. A support device as claimed in claim 2 wherein said engagement means is comprised of a nut.

4. A support device as claimed in claim 1 wherein the side of said triangle opposite said distal corner extends a distance greater than the diameter of said rod.

5. A support device as claimed in claim 1 further comprising anchoring means for securely affixing a drainage channel segment to said bracket means.

6. A support device as claimed in claim 5 wherein said anchoring means is comprised of a pair of bolts threadedly engaged to said bracket means and adapted to securely anchor a drainage channel segment to said bracket means.

* * * * *